US007648337B2

(12) United States Patent
Kuroiwa et al.

(10) Patent No.: US 7,648,337 B2
(45) Date of Patent: Jan. 19, 2010

(54) MULTISTAGE PUMP

(75) Inventors: Sou Kuroiwa, Tokyo (JP); Kenichi Kajiwara, Tokyo (JP); Shoji Ito, Tokyo (JP); Kikuichi Mori, Tokyo (JP); Aki Ishikawa, Tokyo (JP); Tetsutaro Fujiwara, Tokyo (JP)

(73) Assignee: Ebara Corporation, Tokyo (JP)

( * ) Notice: Subject to any disclaimer, the term of this patent is extended or adjusted under 35 U.S.C. 154(b) by 421 days.

(21) Appl. No.: 10/501,885

(22) PCT Filed: Jan. 21, 2003

(86) PCT No.: PCT/JP03/00462

§ 371 (c)(1),
(2), (4) Date: Jul. 20, 2004

(87) PCT Pub. No.: WO03/062645

PCT Pub. Date: Jul. 31, 2003

(65) Prior Publication Data

US 2005/0147505 A1 Jul. 7, 2005

(30) Foreign Application Priority Data

Jan. 21, 2002 (JP) ..... 2002-012185

(51) Int. Cl.
*F01D 25/24* (2006.01)

(52) U.S. Cl. ..... 415/214.1; 415/200; 415/199.1; 417/247; 417/244

(58) Field of Classification Search ..... 417/244, 417/245, 247; 415/199.1, 200, 214.1, 182.1
See application file for complete search history.

(56) References Cited

U.S. PATENT DOCUMENTS 5,256,033 A * 10/1993 Kajiwara ..... 415/214.1

(Continued)

FOREIGN PATENT DOCUMENTS

AT 369 515 B 1/1983

(Continued)

OTHER PUBLICATIONS

Supplementary European Search Report dated May 26, 2009 issued in corresponding Application No. 03701818.1-2315/146902.

*Primary Examiner*—Devon C Kramer
*Assistant Examiner*—Leonard J Weinstein
(74) *Attorney, Agent, or Firm*—Westerman, Hattori, Daniels & Adrian, LLP

(57) ABSTRACT

A multistage pump according to the present invention has a plurality of intermediate casings (2) formed by press-forming a steel plate. The intermediate casing has a cylindrical side portion (21), a stage flat portion (23) with which an axial end face of an adjacent intermediate casing is held in contact, a stage side portion (24) extending axially from the stage flat portion, and a bottom portion (25) extending radially inward from the stage side portion. A relief plate (30) having an outer circumferential end face which is held in contact with an inner surface of a cylindrical side portion of the adjacent intermediate casing is attached to the bottom portion of the intermediate casing. The relief plate, the stage side portion, the stage flat portion, and the inner surface of the cylindrical side portion of the adjacent intermediate casing form a space in which an O-ring (40) is fitted.

6 Claims, 4 Drawing Sheets

U.S. PATENT DOCUMENTS

| | | | | |
|---|---|---|---|---|
| 5,318,403 | A * | 6/1994 | Kajiwara et al. | 415/214.1 |
| 5,369,972 | A * | 12/1994 | Kajiwara et al. | 72/348 |
| 6,343,913 | B1 * | 2/2002 | Ohsaki | 415/199.2 |

FOREIGN PATENT DOCUMENTS

| | | | |
|---|---|---|---|
| DE | 38 16280 | A1 | 11/1989 |
| EP | 55426 | A1 * | 7/1982 |
| EP | 0 492 575 | A1 | 7/1992 |
| JP | 49-94207 | | 8/1974 |
| JP | 52-65065 | | 5/1977 |
| JP | 9-303295 | | 11/1997 |

* cited by examiner

MULTISTAGE PUMP

TECHNICAL FIELD

The present invention relates to a multistage pump, and more particularly to a multistage pump having a plurality of intermediate casings formed by press-forming a steel plate.

BACKGROUND ART

There has heretofore been known a multistage pump having a plurality of intermediate casings formed by press-forming a steel plate, and impellers housed in respective intermediate casings. FIG. 7 is a vertical cross-sectional view showing a structure including intermediate casings in a conventional multistage pump. As shown in FIG. 7, impellers 101 are housed in the intermediate casings 100. The intermediate casing 100 has a cylindrical side portion 102, a fitting portion 103 formed substantially into a sigmoid shape, and a bottom portion 104 extending radially inward from the fitting portion 103.

An axial end face 102*a* and an inner surface 102*b* of a cylindrical side portion 102 of an adjacent intermediate casing are held in contact with the fitting portion 103. The inner surface 120*b* of the cylindrical side portion 102 of the adjacent intermediate casing and the fitting portion 103 having substantially a sigmoid shape form a recess in which an O-ring 110 is fitted. The fitting portion 103 of the intermediate casing is formed by buckling a steel plate through press forming.

However, when the fitting portion 103 of the intermediate casing is formed by press forming, the shape of the recess for the O-ring is unlikely to be fixed due to variations of the hardness or the thickness of a casing material, and thus it is difficult to obtain a stable shape of the fitting portion. Further, a die for press forming is required to have high accuracy. Furthermore, since a special O-ring 110 that is fitted into the shape of the fitting portion 103 is required, cost rises problematically.

DISCLOSURE OF INVENTION

The present invention has been made in view of the above drawbacks of the prior art. It is, therefore, an object of the present invention to provide a multistage pump which can maintain stable sealing capability and stable accuracy in an intermediate casing and can employ a general-purpose O-ring which is inexpensive.

In order to solve the above drawbacks of the prior art, according to a first aspect of the present invention, there is provided a multistage pump having a plurality of intermediate casings formed by press-forming a steel plate, characterized in that each of the intermediate casings has a cylindrical side portion, a stage flat portion with which an axial end face of an adjacent intermediate casing is held in contact, a stage side portion extending axially from the stage flat portion, and a bottom portion extending radially inward from the stage side portion, wherein a relief plate having an outer circumferential end face which is held in contact with an inner surface of a cylindrical side portion of the adjacent intermediate casing is attached to the bottom portion of the intermediate casing, wherein the relief plate, the stage side portion, the stage flat portion, and the inner surface of the cylindrical side portion of the adjacent intermediate casing form a space in which an O-ring is fitted.

According to a second aspect of the present invention, there is provided a multistage pump having a plurality of intermediate casings formed by press-forming a steel plate, characterized in that each of the intermediate casings has a cylindrical side portion, a stage flat portion with which an axial end face of an adjacent intermediate casing is held in contact, a stage side portion extending axially from the stage flat portion, and a bottom portion extending radially inward from the stage side portion, wherein a relief plate having an outer circumferential end face which is held in contact with an inner surface of a cylindrical side portion of the adjacent intermediate casing is attached to the bottom portion of the intermediate casing, wherein the relief plate, the stage side portion, the stage flat portion, and the inner surface of the cylindrical side portion of the adjacent intermediate casing form a space in which an O-ring is fitted, wherein a return vane interposed between a side plate and the relief plate is formed integrally with the relief plate.

According to the present invention, a multistage pump can have a simple structure which can be manufactured simply by press forming. Accordingly, it is possible to readily form a recess for an O-ring disposed between intermediate casings with high accuracy. Thus, it is possible to maintain stable sealing capability and stable accuracy. Such a recess for an O-ring can be changed in shape such that a commercially available O-ring is fitted in the recess. Thus, since any commercially available O-ring can be used, cost can be reduced. According to the second aspect of the present invention, it is not necessary to weld a relief plate and a return vane, and hence productivity can be improved.

According to a preferred aspect of the present invention, the multistage pump is characterized in that a height of the return vane at an outer circumferential side is larger than that at an inner circumferential side. Thus, a passage cross-section is widened at an inlet side of the return vane to lower a flow velocity and to reduce a loss which would be caused by a step corresponding to the thickness of the relief plate.

According to a preferred aspect of the present invention, the multistage pump is characterized in that the relief plate is attached to the bottom portion at a position near its outermost portion so as to form a gap between a radially inner portion of the relief plate and the bottom portion of the intermediate casing according to an amount of deformation of the bottom portion due to a differential pressure between stages.

A differential pressure between stages, which is produced by a pressure of the fluid pressurized by an impeller, is applied to an inner surface of the bottom portion so as to expand the bottom portion toward the low pressure side. However, with the above arrangement, since a gap is preformed between the bottom portion and the relief plate, the amount of deformation due to the differential pressure between the stages is cancelled by the gap. Accordingly, the relief plate is not subjected to the influence of the deformation of the bottom portion and is not broken.

BEST MODE FOR CARRYING OUT THE INVENTION

Figure 1:
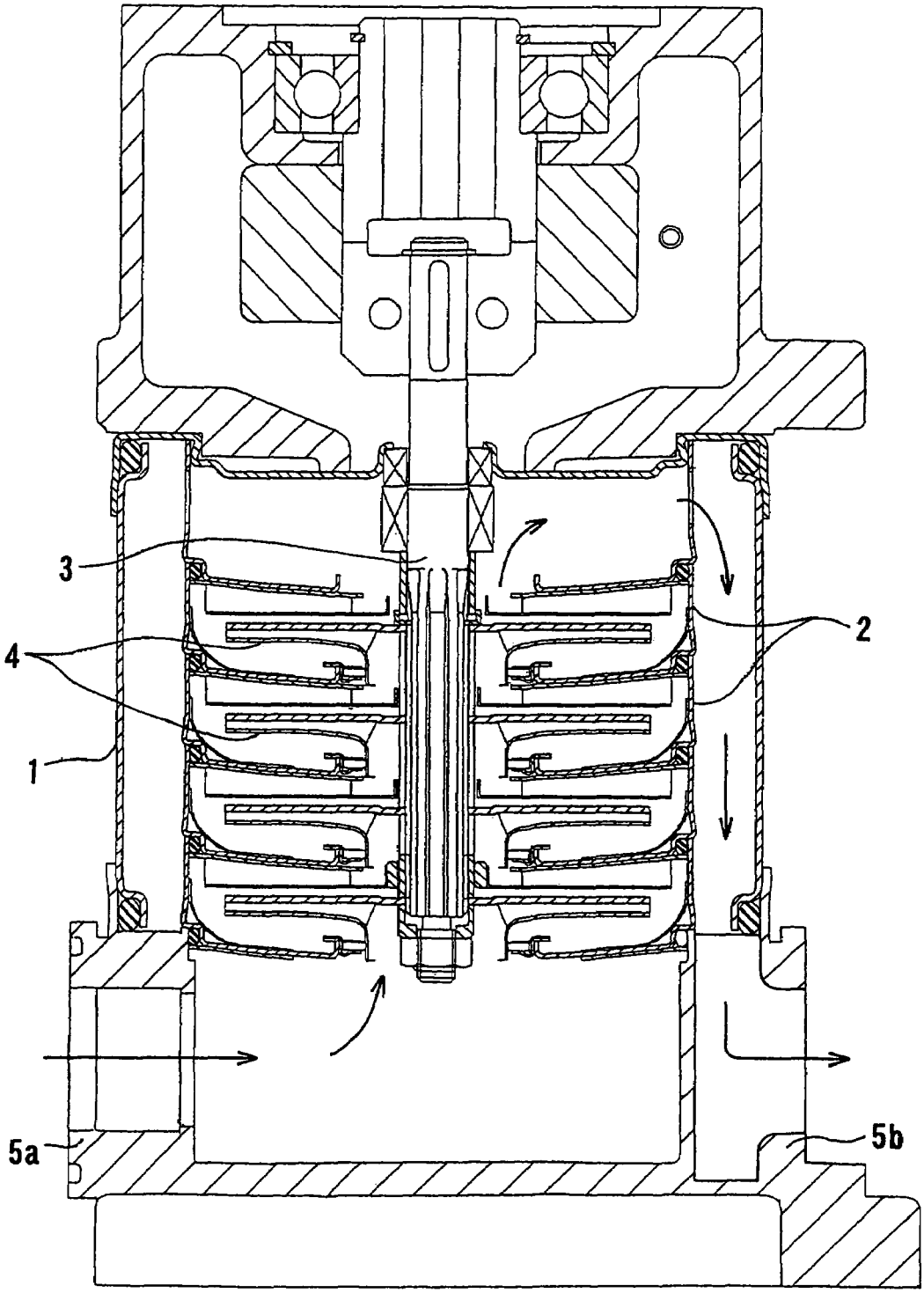
FIG. 1 is a vertical cross-sectional view showing a multistage pump according to a first embodiment of the present invention.

A multistage pump according to embodiments of the present invention will be described below in detail with reference to FIGS. 1 through 6. In FIGS. 1 through 6, like or corresponding parts are denoted by the same reference numerals, and will not be described below repetitively.

FIG. 1 is a vertical cross-sectional view showing a multistage pump according to a first embodiment of the present invention. In the multistage pump according to the present embodiment, a plurality of intermediate casings 2 is housed in an outer casing 1, and impellers 4 attached to a main shaft 3 are housed in the respective intermediate casings 2.

Figure 2:
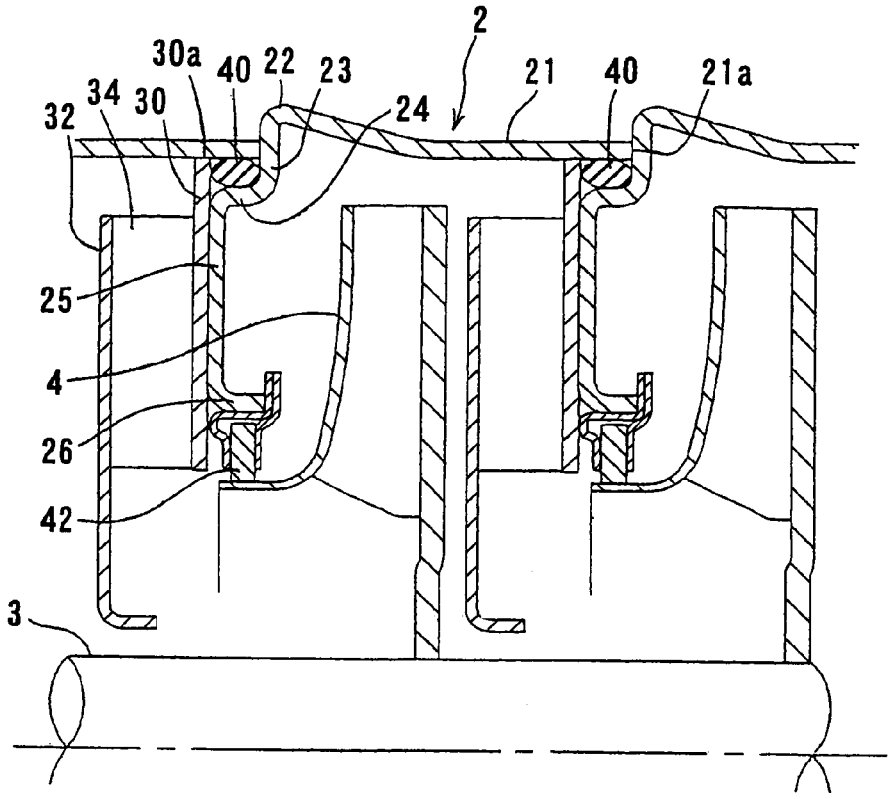
FIG. 2 is a partial enlarged view showing a structure including intermediate casings shown in FIG. 1.

FIG. 2 is a partial enlarged view showing a structure including the intermediate casings shown in FIG. 1. As shown in FIG. 2, each of the intermediate casings 2 in the present embodiment is formed substantially into a cylindrical receptacle. The intermediate casing 2 includes a cylindrical side portion 21, a protruding portion 22 protruding radially outward from the cylindrical side portion 21, a stage flat portion 23 extending radially inward from the protruding portion 22, a stage side portion 24 extending axially from the stage flat portion 23, and a bottom portion 25 extending radially inward from the stage side portion 24. The intermediate casing 2 is produced by press-forming a steel plate.

The protruding portion 22 has an outside diameter larger than the outside diameter of the cylindrical side portion 21. The stage side portion 24 has an outside diameter slightly smaller than the inside diameter of the cylindrical side portion 21. The stage flat portion 23 is arranged so as to be perpendicular to the cylindrical side portion 21. The cylindrical side portion 21 has an axial end face 21*a* which is held in contact with a stage flat portion 23 of an adjacent intermediate casing 2 substantially over the entire surface of the axial end face 21*a*. As long as the end face of the cylindrical side portion 21 can maintain a contacting area with the adjacent stage flat portion 23, the stage flat portion 23 may be inclined at a predetermined angle with respect to the cylindrical side portion 21 rather than perpendicular to the cylindrical side portion 21.

A relief plate 30 is attached to the bottom portion 25 of the intermediate casing 2 by welding. Return vanes 34 are interposed between the relief plate 30 and a side plate 32 and welded to the relief plate 30 and the side plate 32. An outer circumferential end face 30*a* of the relief plate 30 is held in contact with an inner circumferential surface of a cylindrical side portion 21 of an adjacent intermediate casing 2. The relief plate 30, the stage side portion 24, the stage flat portion 23, and the inner surface of the cylindrical side portion 21 of the adjacent intermediate casing 2 form a space in which an O-ring 40 is fitted. Thus, according to the present invention, the intermediate casing 2 has a simple structure which can be manufactured simply by press forming. Accordingly, it is possible to readily form a recess for an O-ring disposed between adjacent intermediate casings with high accuracy. Thus, it is possible to maintain stable sealing capability and stable accuracy. Such a recess for an O-ring can be changed in shape such that a commercially available O-ring is fitted in the recess. Thus, since any commercially available O-ring can be used, cost can be reduced.

A liner ring 42 is attached to an inner edge portion 26 of the bottom portion 25 of the intermediate casing 2, and a small gap is formed between the liner ring 42 and a suction portion of the impeller 4. The liner ring 42 prevents water having a high pressure from leaking into the suction portion.

During operation of the pump, a pumping liquid drawn from a suction port 5*a* (see FIG. 1) is pressurized by the impellers 4 rotated by the main shaft 3. The pressurized pumping liquid is introduced into a suction portion of a subsequent impeller 4 through a passage formed by the return vanes 34 interposed between the relief plate 30 and the side plate 32. Thus, the pumping liquid is pressurized by each stage of the impellers 4, recovered in pressure while flowing through a passage formed by each stage of the return vanes 34, and finally discharged from a discharge port 5*b* (see FIG. 1) of to the exterior of the pump.

Figure 3:
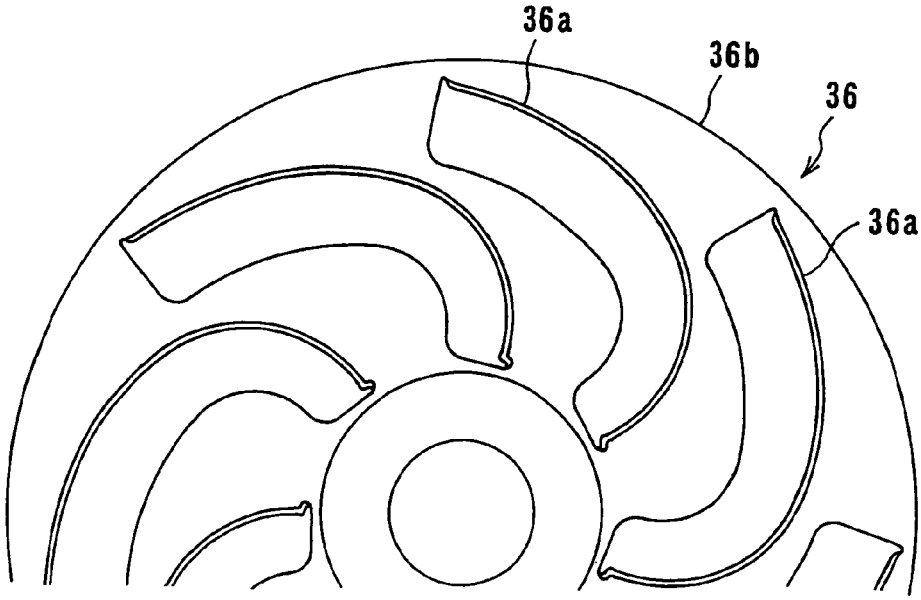
FIG. 3 is a plan view showing a portion of a relief plate in a case where a relief plate and return vanes are formed integrally with each other.

In this case, the relief plate and the return vanes may be formed integrally with each other. FIG. 3 is a plan view showing a portion of a relief plate 36 in a case where a relief plate and return vanes are formed integrally with each other. In the relief plate 36 shown in FIG. 3, a disk-like steel plate is folded into return vanes 36*a* so as to form the return vanes 36*a* and the relief plate body 36*b* integrally with each other. Thus, it is not necessary to weld a relief plate and return vanes, and hence productivity can be improved.

Figure 4:
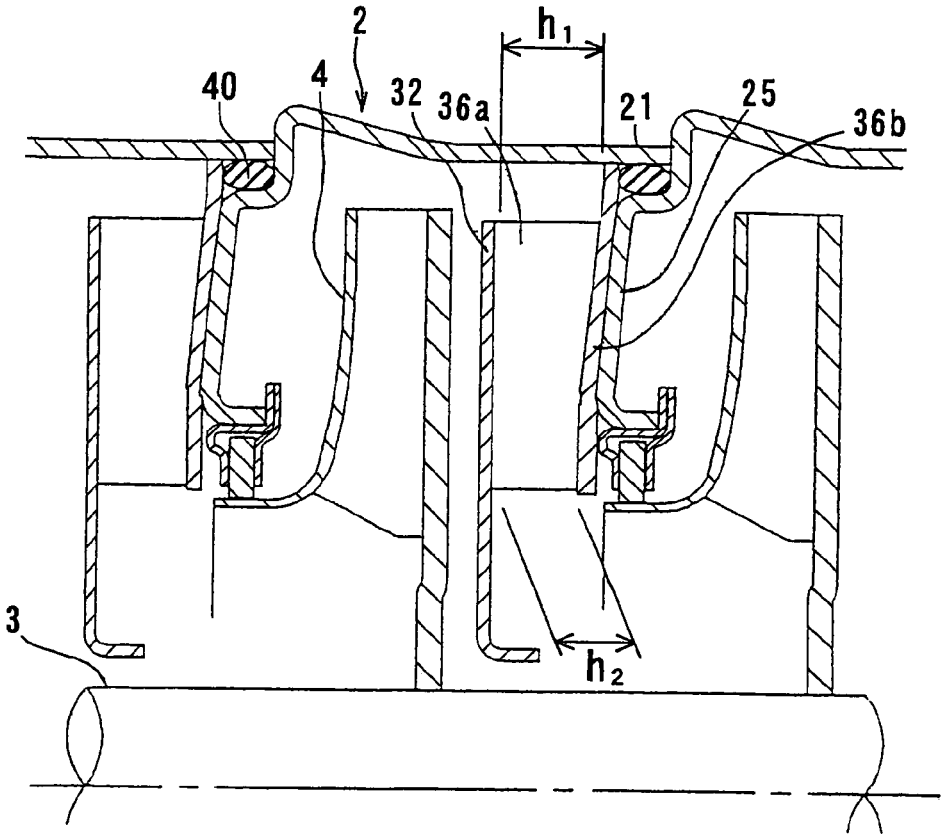
FIG. 4 is a vertical cross-sectional view showing a structure including intermediate casings according to a second embodiment of the present invention.

FIG. 4 is a vertical cross-sectional view showing a structure including intermediate casings according to a second embodiment of the present invention. When the return vanes 36*a* and the relief plate body 36*b* are formed integrally with each other as shown in FIG. 3, steps corresponding to the thickness of the relief plate body 36*b* are formed at base portions of the return vanes 36*a*. The steps enlarge the passages abruptly to cause a loss. Accordingly, in the second embodiment, as shown in FIG. 4, the height h1 of the return vanes 36*a* at inlet sides, i.e., the height of the return vanes 36*a* at outer circumferential sides is larger than the height h2 of the return vanes 36*a* at outlet sides. Thus, passage cross-sections are widened at the inlet sides to lower the flow velocity and to reduce the loss.

Figure 5:
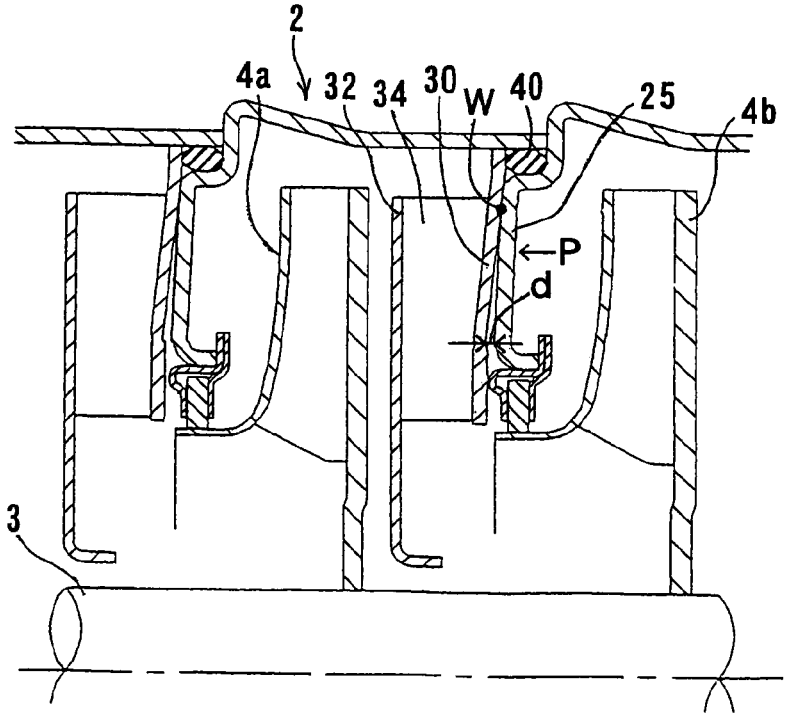
FIG. 5 is a vertical cross-sectional view showing a structure including intermediate casings according to a third embodiment of the present invention.

FIG. 5 is a vertical cross-sectional view showing a structure including intermediate casings according to a third embodiment of the present invention. A pumping liquid pressurized by the impeller 4*a* is introduced through a passage formed by the return vanes 34 into a subsequent impeller 4*b*. Further, a fluid pressure of the pressurized fluid is applied to a back side of the bottom portion 25. Thus, a difference between a fluid pressure in the return vanes 34 and a fluid pressure on the back side of the bottom portion 25 (differential pressure between stages) is applied in a direction indicated by an arrow P in FIG. 5. Accordingly, the bottom portion 25 is deformed on a low pressure side from a radially outward portion to a radially inward portion. If the amount of deformation is large, then an excessive stress is produced at welding portions of the bottom portion 25 with the return vanes 34 so as to cause breakage of the bottom portion 25.

Figure 6:
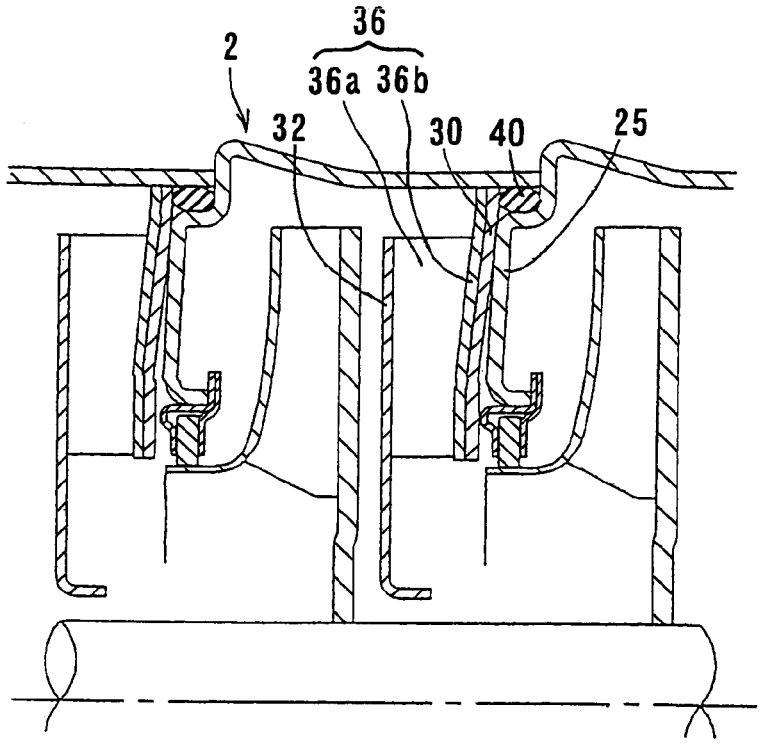
FIG. 6 is a vertical cross-sectional view showing a structure including intermediate casings according to another embodiment of the present invention.
Figure 7:
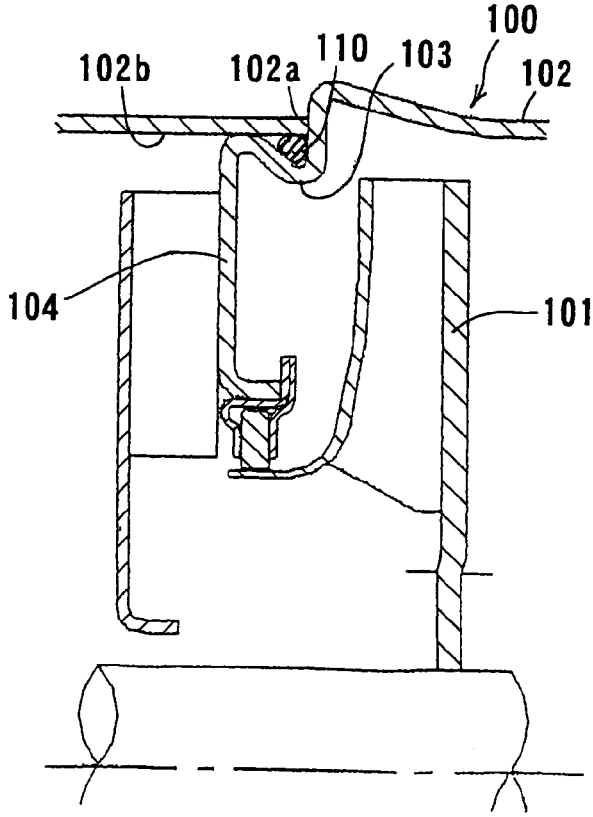
FIG. 7 is a vertical cross-sectional view showing a structure including intermediate casings of a conventional multistage pump.

Accordingly, in the present embodiment, the relief plate 30 and the bottom portion 25 are welded at a portion W near the outermost portion so as to form a gap between a radially inner portion of the relief plate 30 and the bottom portion 25. The size d of the gap is set so as not to deform the relief plate 30 provided adjacent to the bottom portion 25 even if the bottom portion 25 is deformed due to a pressure produced by the impeller 4*b*. Specifically, the size d of the gap is set such that the bottom portion 25 is brought into light contact with the relief plate 30 or otherwise is not brought into contact with the relief plate 30 even if the bottom portion 25 is deformed. A differential pressure between the stages, which is produced by a pressure of the fluid pressurized by the impeller 4*b*, is applied to an inner surface of the bottom portion 25 so as to expand the bottom portion 25 toward the low pressure side. However, since a gap d is preformed between the bottom portion 25 and the relief plate 30, the amount of deformation due to the differential pressure between the stages is cancelled by the gap d. Accordingly, the relief plate 30 attached to the bottom portion 25 by welding at the portion W near the outermost portion is not subjected to the influence of the deformation of the bottom portion 25 and is not broken. In this case, as shown in FIG. 6, a relief plate 36 having return vanes 36*a* and a relief plate body 36*b* formed integrally with each other as shown in FIG. 3 may be attached to the relief plate 30 attached to the bottom portion 25.

While the present invention has been described with reference to the embodiments thereof, the present invention is not limited to the above embodiments. Thus, it would be apparent that various modifications may be made therein without departing from the technical concept of the present invention.

As described above, according to the present invention, a multistage pump can have a simple structure which can be manufactured simply by press forming. Accordingly, it is possible to readily form a recess for an O-ring disposed between intermediate casings with high accuracy. Thus, it is possible to maintain stable sealing capability and stable accuracy. Such a recess for an O-ring can be changed in shape such that a commercially available O-ring is fitted in the recess. Thus, since any commercially available O-ring can be used, cost can be reduced.

INDUSTRIAL APPLICABILITY

The present invention can suitably be used for a multistage pump having a plurality of intermediate casings formed by press-forming a steel plate.

The invention claimed is:

1. A multistage pump having a plurality of intermediate casings formed by press-forming a steel plate, characterized in that:

each of said intermediate casings has a cylindrical side portion, a protruding portion protruding radially outward from the cylindrical side portion, a stage flat portion extending radially inward from the protruding portion and with which an axial end face of an adjacent intermediate casing is held in contact, a stage side portion extending axially from said stage flat portion, and a bottom portion extending radially inward from said stage side portion, wherein said cylindrical side portion, said protruding portion, said stage flat portion, said stage side portion and said bottom portion are integrally formed from said steel plate by said press-forming, wherein said protruding portion has an outside diameter larger than the outside diameter of the cylindrical side portion, and said stage side portion has an outside diameter smaller than the inside diameter of the cylindrical side portion, wherein a relief plate having an outer circumferential end face which is held in contact with an inner surface of a cylindrical side portion of said adjacent intermediate casing is attached to said bottom portion of said intermediate casing, wherein said relief plate, said stage side portion, said stage flat portion, and said inner surface of said cylindrical side portion of said adjacent intermediate casing form a space in which an O-ring is fitted, wherein said bottom portion functions as a wall separating said intermediate casings.

2. The multistage pump as recited in claim 1, characterized in that said relief plate is attached to said bottom portion at a position near its outermost portion so as to form a gap between a radially inner portion of said relief plate and said bottom portion of said intermediate casing according to an amount of deformation of said bottom portion due to a differential pressure between stages.

3. A multistage pump having a plurality of intermediate casings formed by press-forming a steel plate, characterized in that:

each of said intermediate casings has a cylindrical side portion, a protruding portion protruding radially outward from the cylindrical side portion, a stage flat portion extending radially inward from the protruding portion and with which an axial end face of an adjacent intermediate casing is held in contact, a stage side portion extending axially from said stage flat portion, and a bottom portion extending radially inward from said stage side portion, wherein said cylindrical side portion, said protruding portion, said stage flat portion, said stage side portion and said bottom portion are integrally formed from said steel plate by said press-forming, wherein said protruding portion has an outside diameter larger than the outside diameter of the cylindrical side portion, and said stage side portion has an outside diameter smaller than the inside diameter of the cylindrical side portion, wherein a relief plate having an outer circumferential end face which is held in contact with an inner surface of a cylindrical side portion of said adjacent intermediate casing is attached to said bottom portion of said intermediate casing, wherein said relief plate, said stage side portion, said stage flat portion, and said inner surface of said cylindrical side portion of said adjacent intermediate casing form a space in which an O-ring is fitted, wherein said bottom portion functions as a wall separating said intermediate casings, wherein a return vane interposed between a side plate and said relief plate is formed integrally with said relief plate.

4. The multistage pump as recited in claim 3, characterized in that a height of said return vane at an outer circumferential side is larger than that at an inner circumferential side.

5. The multistage pump as recited in claim 4, characterized in that said relief plate is attached to said bottom portion at a position near its outermost portion so as to form a gap between a radially inner portion of said relief plate and said bottom portion of said intermediate casing according to an amount of deformation of said bottom portion due to a differential pressure between stages.

6. The multistage pump as recited in claim 3, characterized in that said relief plate is attached to said bottom portion at a position near its outermost portion so as to form a gap between a radially inner portion of said relief plate and said bottom portion of said intermediate casing according to an amount of deformation of said bottom portion due to a differential pressure between stages.

* * * * *